US007661469B1

(12) United States Patent
O'Loughlin

(10) Patent No.: US 7,661,469 B1
(45) Date of Patent: Feb. 16, 2010

(54) SYNCHRONIZED THERMAL MANAGEMENT METHOD

(75) Inventor: James P. O'Loughlin, Placitas, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 183 days.

(21) Appl. No.: 12/110,427

(22) Filed: Apr. 28, 2008

(51) Int. Cl.
*F28F 27/00* (2006.01)

(52) U.S. Cl. ..... 165/269; 165/267; 165/218; 165/50; 165/206; 236/78 R; 236/78 D; 236/1 B; 236/46 F; 236/46 R; 236/9 A; 236/37; 237/8 A; 237/8 R; 237/63

(58) Field of Classification Search ..... 165/269, 165/267, 218, 50, 206; 236/78 R, 78 D, 1 B, 236/46 F, 46 R, 9 A, 37; 237/8 A, 8 R, 63
See application file for complete search history.

(56) References Cited

U.S. PATENT DOCUMENTS

| | | | | | |
|---|---|---|---|---|---|
| 3,425,485 | A * | 2/1969 | Newton | ..... | 165/218 |
| 3,593,780 | A * | 7/1971 | Donnelly | ..... | 165/218 |
| 3,910,345 | A * | 10/1975 | Whalen | ..... | 165/221 |
| 4,262,737 | A * | 4/1981 | Faillace | ..... | 165/267 |
| 4,446,912 | A * | 5/1984 | Rickman, Jr. | ..... | 165/219 |
| 4,759,498 | A * | 7/1988 | Levine et al. | ..... | 236/46 R |
| 6,997,389 | B2 * | 2/2006 | Demster | ..... | 236/46 R |

* cited by examiner

*Primary Examiner*—John K Ford
(74) *Attorney, Agent, or Firm*—Kenneth E. Callahan

(57) ABSTRACT

A method of cooling a plurality of devices operated in parallel and heated by relatively long duration pulses using a single coolant flow channel to the devices in series that transports the heat from the several devices in a contiguous series of heat pulses to the heat exchanger.

1 Claim, 5 Drawing Sheets

Temperature rise of pulses as emerging from device 4 in FIG. 2
With $\Delta t_{34}$ = 650 ms, $\Delta t_{23}$ = 450 ms, and $\Delta t_{12}$ = 250 ms
Start up transient with transition to steady state is shown

SYNCHRONIZED THERMAL MANAGEMENT METHOD

STATEMENT OF GOVERNMENT INTEREST

The conditions under which this invention was made are such as to entitle the Government of the United States under paragraph I(a) of Executive Order 10096, as represented by the Secretary of the Air Force, to the entire right, title and interest therein, including foreign rights.

BACKGROUND OF THE INVENTION

This invention relates generally to the field of heat exchange systems, and in particular a thermal management system for cooling multiple devices operated in parallel and heated by high duty cycle long duration pulses.

Long duration pulsed devices require a coolant flow that is the same as the flow required for the continuous flow operation of the device even though the total heat load is reduced by the duty cycle of operation. Historically, for several devices operating in parallel, i.e., in a synchronized manner, (see FIG. 1), each is provided with a separate coolant flow, each of which is under-utilized.

FIG. 1 is a simplified diagram of four parallel synchronized devices with four parallel coolant loops. The flow is provided by a pump which circulates the flow through the devices and then the combined flow through the heat exchanger. The coolant flowing through the devices during the time between the heat pulses is not utilized for transporting heat to the heat exchanger. The heat exchanger performance depends upon the inlet temperature. The higher the inlet temperature the more effective is the heat exchanger. In this case the inlet temperature follows the heat pulsed profile so only operates periodically at peak efficiency. Between the heating pulses the coolant has a low temperature and thus the heat exchanger operates inefficiently. These periods of inefficiency are actually long compared to the effective time when the inlet temperature is high.

The flow required for continuous operation of the device at a power dissipation of P watts per device, is:

$$F = \frac{P}{\sigma \cdot \delta \cdot \Delta T} \tag{1}$$

Where: F=coolant flow per device in liters/second

P=heat power per device, Watts

δ=density of the coolant, kg/liter

σ=heat capacity of the coolant, Joules/kg/C.°

ΔT=temperature increase in the coolant, C.°

When the thermal pulse duration is longer than the thermal time constant of the device, typically 1 to 10 milliseconds, the required coolant flow reaches the continuous flow requirement given by equation 1. Control of the flow such that it is only on when the heat pulse is present would reduce the total flow requirement. However, starting and stopping the flow on a millisecond time scale is not practical or even possible to implement. The end result is a full continuous flow for each of the devices and a utilization of flow that is equal to the duty cycle of the heat pulses. The duty cycle is the ratio of the time the heat pulse is on to the repetition period of the heat pulses.

SUMMARY

The invention provides a means of thermal management for a system consisting of multiple pulsed parallel devices which increases the utilization of the coolant, reduces the size and weight of the heat exchanger, and increases the efficiency of the heat rejection to the heat sink. The peak coolant flow requirement for devices operated in a long pulse manner is the same as for the device in continuous operation. The coolant flow between pulses is not utilized since there is no heat generated in this time period. When several devices are operating in parallel, this under-utilized flow is duplicated for each device. The present invention uses a single flow channel to several devices in series and synchronizes the flow by means of delay sections such that the un-utilized portion of the flow passes through the device as the pulsed heat load occurs. The end result is a single coolant flow channel that transports the heat from several devices in a contiguous series of heat pulses to the heat exchanger. Thus the number of coolant flow channels is reduced to one, the heat content of this channel is increased, and the average input temperature to the heat exchanger is increased thereby increasing its efficiency.

DESCRIPTION OF THE PREFERRED EMBODIMENT

Figure 1:
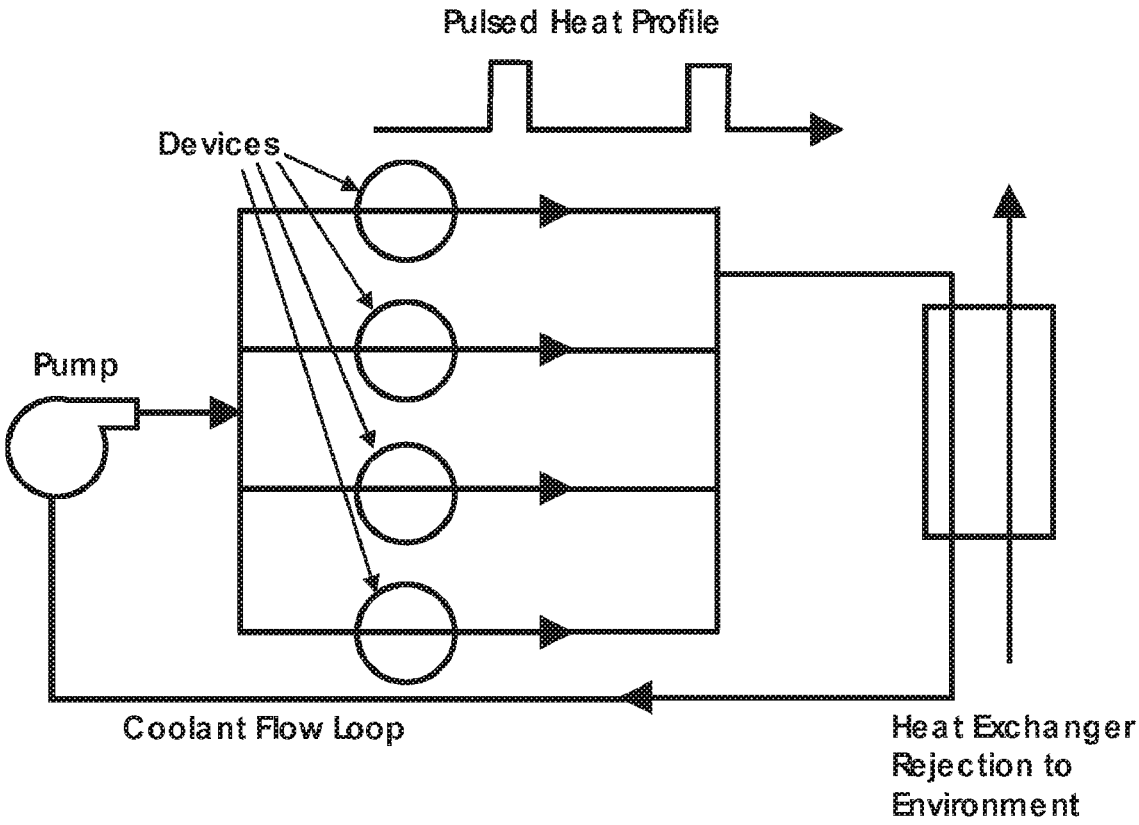
FIG. 1 is a diagram of a typical coolant flow loop for four devices operated in parallel showing separate coolant flow to each device and a pulsed heat profile.
Figure 2:
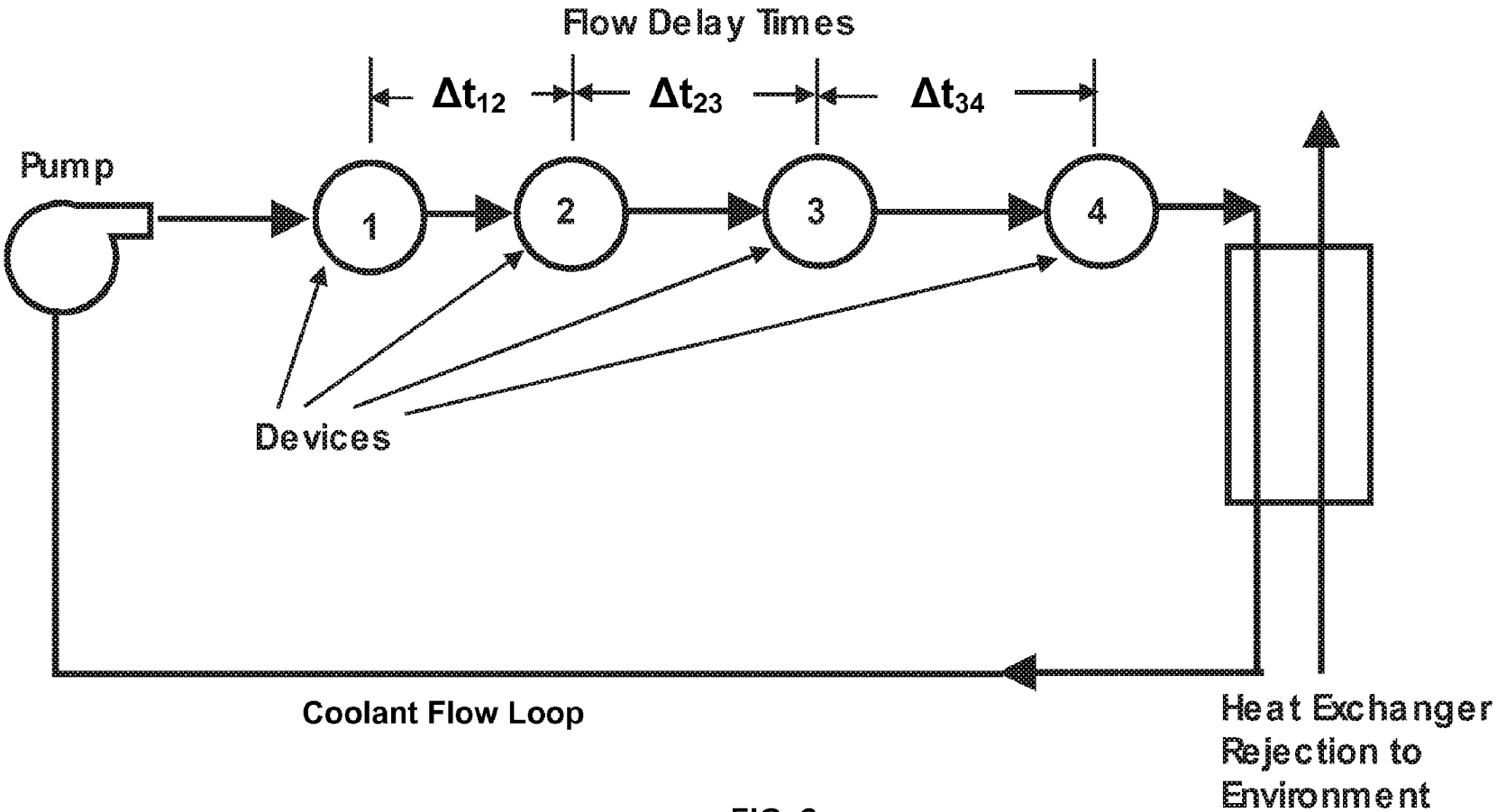
FIG. 2 shows an embodiment of the invention in which the coolant flows through four devices in series with a delay time Δt determined by the coolant flow velocity and the delay length of the flow channel.

The basic concept of the present invention is shown in FIG. 2. Instead of separate full continuous flow being directed through each of the four devices in parallel as in FIG. 1, a single full continuous flow is directed through the devices in series. Although the devices are synchronous in time, the heat flow between the devices has a delay time determined by the coolant flow velocity and the delay length of the flow channel. The purpose of the various delay times between heat pulses is to deposit the heat pulses in the coolant flow stream in sequential contiguous positions such that the heat content of the flow is uniform as it enters the heat exchanger.

Figure 3:
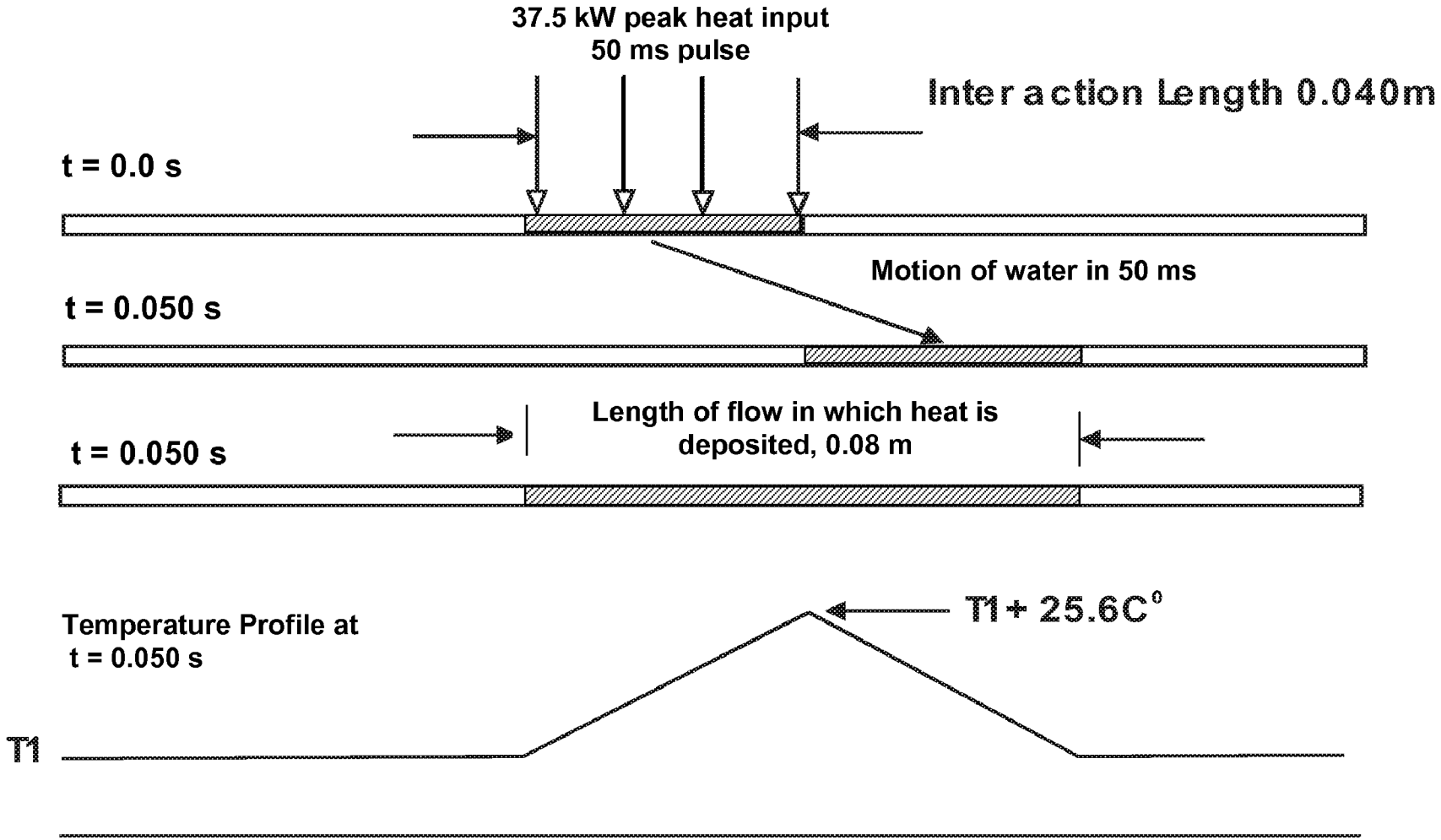
FIG. 3 shows how the heat pulse is deposited into the coolant as it passes through a single device and the resultant temperature profile.

A particular implementation with four heat sources is used to explain the invention in more detail. In this example each of the devices has a heat power dissipation of 37.5 kW peak and 9.375 kW average, with a pulse width of 50 milliseconds at a repetition period of 200 milliseconds (25% duty cycle). The thermal time constant of the device is taken to be much less than the 50 ms pulse width so that the coolant flow required is that of the continuous steady state case given by equation 1. The coolant is water and the temperature rise is taken as 25.6 C.°. By equation 1 the required flow is 0.350 liters/second or $0.350\times10^{-3}$ $m^3/s$. The cross sectional area of the flow channel is taken to be $0.4375\times10^{-3}$ $m^2$ for a flow velocity of 0.80 m/s. The specific delay of the flow is 1.25 seconds/meter. The flow length of a 50 ms heat pulse is 0.040 meters. The flow length of the 200 ms pulse repetition interval is 0.160 meters. The length of the interaction of the heat with the coolant is 0.040 meters, which matches the flow velocity; that is, during the 50 ms heat pulse, 0.040 meters of water moves through the 0.040 meter interaction length. Thus the heat pulse is deposited into a length of flow that is 0.080 m. FIG. 3 shows this pulsed heating sequence and the resultant temperature profile of the coolant for a single device.

Figure 4:
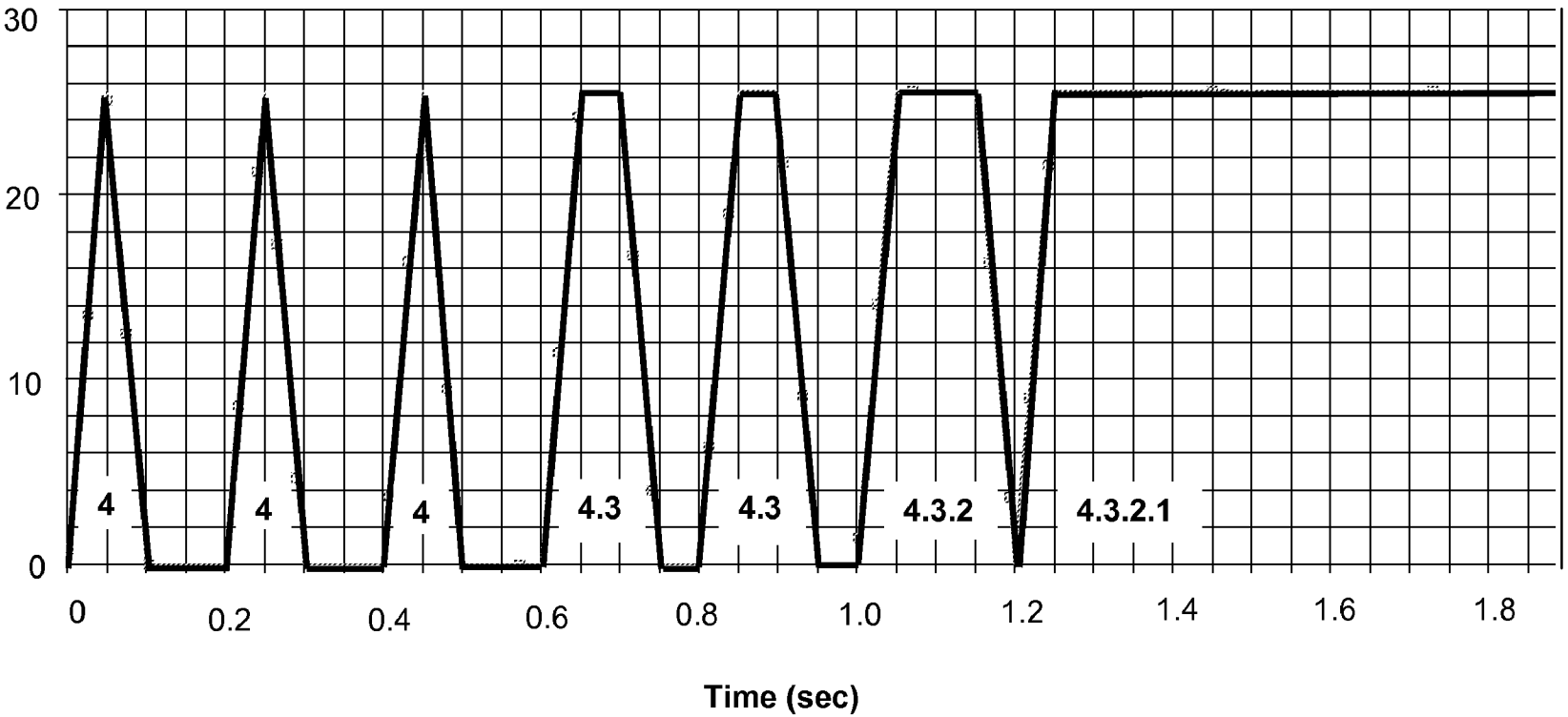
FIG. 4 is a plot of the temperature rise of the coolant from heat pulses as the coolant emerges from device 4 of FIG. 2. The start up transient with transition to steady state is shown.

Consider the steady state operation of the system in FIG. 2. If the delay time, $\Delta t_{34}$, is an integral multiple of the repetition interval, 200 ms, then a heat pulse from device 3 will coincide with the temperature pulse from device 4. If this delay interval is either 50 ms longer or shorter, then the temperature pulse from device 3 will arrive at the output of device 4, respectively, and contiguously overlapping after or before the temperature pulse from device 4. The same rational applies with respect to the temperature pulses from devices 1 and 2. Specifically, if the delay between any two consecutive devices is an integral of 200 ms plus or minus 50 milliseconds, the temperature pulses emerging from device 4, and thence to the heat exchanger, will be contiguously overlapping and sequential as illustrated in FIG. 3, provided that the 50 ms differences in the inter-device delays ($\Delta$t's) are either all positive or all negative. Given the arrangement as described, the temperature pulses emerging from device 4 and thence to the heat exchanger (FIG. 3), will be sequenced as shown in FIG. 4. The sequencing is shown for a positive 50 ms inter device delay difference. The start-up transient is shown as it transitions into the steady state. All devices begin pulsing simultaneously at t=0.0 seconds, and continue at a pulse repetition period of 200 ms.

The total flow for n devices without implementation of the invention requires n times the coolant flow of a single device, whereas with the invention only a single device flow is required for all n devices. The coolant temperature rise without the invention is only 1/n times the temperature rise of the coolant flow with the invention implemented. Without the invention the heat exchanger must accommodate n times the coolant flow with a temperature rise of 1/n, compared to the case with when the invention is implemented.

Figure 5:
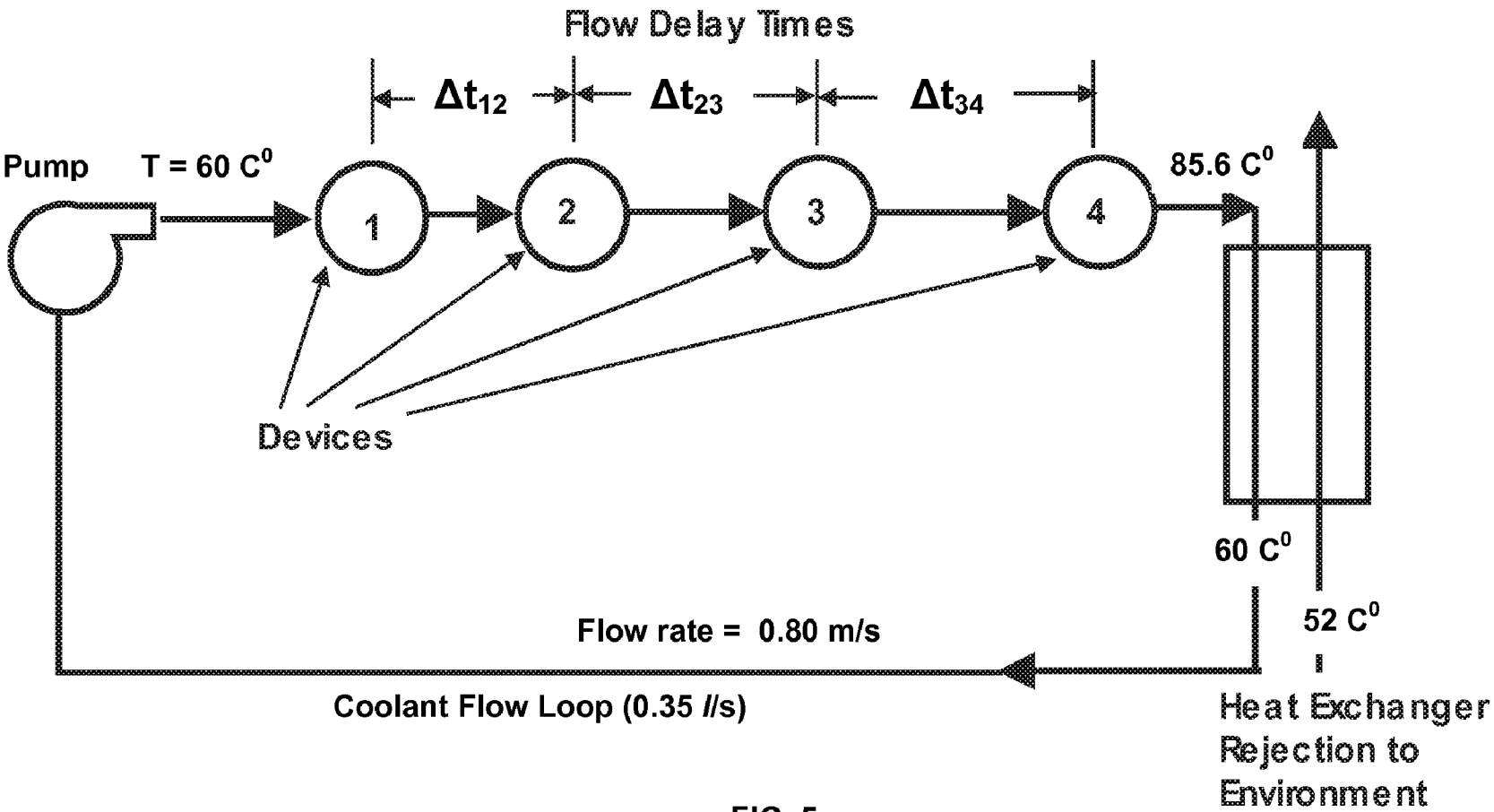
FIG. 5 shows FIG. 2 with example parameters.

The impact on the heat exchanger required performance rating is a factor of $n^2$ more demanding without the invention compared to with the invention. This impact is more clearly illustrated by consideration of the previous example. In this example the peak temperature rise of the coolant is 25.6 C.° and the flow is 0.35 liters/second (See FIG. 5. The heat exchanger is required to remove this heat from the flow. For this example the outlet temperature of the heat exchanger, which is also the base inlet temperature to the device, is taken as 60 C.°. Thus the peak outlet from the device is 85.6 C.°. The heat exchanger efficiency or effectiveness is taken to be 75 percent. The rating of the heat exchanger is specified as the heat removed in watts per degree C. inlet temperature difference. The inlet temperature difference refers to the difference between the hot coolant inlet to the heat exchanger (85.6 C.°) and the cold fluid inlet temperature to the heat exchanger (52 C.°). This quantity is designated as the Q of the heat exchanger. When the invention is implemented with the four devices, as in FIG. 2, there is a constant coolant inlet temperature to the heat exchanger at 0.35 liters/second of 85.6 C.°. The inlet temperature of the heat exchanger's cooling fluid (air) is taken to be 52 C.°, so the inlet temperature difference is 85.6 C.°−52 C.°=33.6 C.°. At 75 percent efficiency this drops the coolant temperature to (85.6−(0.75×33.6))≈60 C.°. From the definition of Q, and the power being remove by the heat exchanger, the required Q is determined as Q=37500/33.6=1116.1 W/C.°.

In the case of individual coolant flowing to each of the devices, the calculation of the required Q is more complicated. The additional complication results from the fact that the temperature of the inlet coolant is a triangular shape instead of a simple constant level when the invention is used. The temperature inlet coolant has a linear rise from 60 C.° to 85.6 C.° in 0.05 seconds and then falls linearly from 85.6 C.° to 60 C.° in 0.05 seconds. The total energy in this waveform corresponds to the input power of 37.5 kW over a 0.05 second pulse, which is 1875 Joules. The heat exchanger must have a Q rating which removes this amount of energy as the triangular temperature pulse passes through. By integrating the power removed by the heat exchanger over the time of the temperature pulse, also determines the energy as a function of Q. By equating this result to the total energy, 1875 Joules, the required value of Q is determined.

The inlet temperature difference as a function of time over the zero to 0.05 second linear rise is:

$$\Delta T(t)=512\cdot t(0\geqq t\leqq 0.05) \tag{2}$$

The power removed by the heat exchanger during this period as a function time and Q is:

$$W(t)=Q\cdot\Delta T(t)=Q\cdot 512\cdot t \tag{3}$$

The energy removed over the 0.05 second linear rise is determined by integration of equation 3 as:

$$J=\int_0^{0.050} Q\cdot 512\cdot t\cdot dt=Q\cdot 0.64 \tag{4}$$

By symmetry the same amount of energy is removed during the 0.05 second linear fall, thus the total energy in terms of Q can be equated to the known energy of 1875 Joules and the solved for the required Q as:

$$Q=\frac{1875}{2\cdot 0.64}=1464.8 \tag{5}$$

In the case without the invention, each device requires a heat exchanger Q rating of 1464.8 for a total heat exchanger Q rating of 5859.4, compared to the total require Q rating of 1116.1 when the invention is used. In this example, the invention reduces the total heat exchanger rating by a factor of 5.25 which relates to a reduction, in a proportional manner, to the size and weight.

The above example consisted of four heat producing devices operating with a 25% duty cycle, thus when temporally sequenced according to the invention, the resultant heat flow delivered to the heat exchanger was a continuous 100% duty cycle flow. In general, it logically follows that, when there are n source devices, each operating at a duty cycle of 1/n and when the time delays prescribed according to the invention are applied, the resultant heat flow to the heat exchanger will be a continuous 100% duty cycle flow.

In particular applications the relation between duty cycle and total number of devices may not be related in an n to 1/n manner. For example, if there are 4 devices and the duty cycle is 12.5 percent, the invention may still be applied to advantage. By arranging the devices in series according to the teaching of the invention, the total coolant flow required is reduced by a factor of 4 and the average temperature of the coolant rise is increased by a factor of four. However, the combined hot flow duty cycle in now only 50% instead of 100% as would be the case if the duty cycle were 25% per device. Even so, the total heat exchanger Q requirement is reduced to about half of that required without the invention. In general when there are several devices, implementation of the invention is beneficial even if the n to 1/n relation is not full filled exactly.

The invention claimed is:

1. A method for removing heat from a plurality of n devices, where n is between 2 and 10, said devices being operated in a pulsed synchronized fashion such that the heat generated by each device occurs in a high duty cycle pulsed manner, said pulsed operation occurring at a constant pulse repetition frequency and cycle period, said high duty cycle being defined as device operation during less than or equal to 1/n of the pulsed cycle period, the method comprised of:

a. providing a coolant, a coolant flow loop channel, a coolant pump, and a heat exchanger;

b. connecting said n devices in series to said coolant flow loop channel, each device being separated from the subsequent device by a predetermined length of coolant flow loop channel;

c. pumping said coolant through each device in series at a constant flow rate; and d. delaying the time of coolant flow between the devices by an integer multiple of the pulse cycle period plus or minus the duty cycle period, said flow delay between devices being determined by the coolant flow rate and the length of the portion of coolant flow loop channel between each device, whereby the coolant temperature profile emerging from the nth device will be approximately contiguous, overlapping, and sequential.

* * * * *